United States Patent [19]

Bouette

[11] 4,168,975

[45] Sep. 25, 1979

[54] ELECTROPHOTOGRAPHIC IMAGE RECEIVING PLATES

[75] Inventor: Rodger D. Bouette, Melbourne, Australia

[73] Assignee: Repco Limited, Melbourne, Australia

[21] Appl. No.: 804,289

[22] Filed: Jun. 7, 1977

[30] Foreign Application Priority Data

Jun. 17, 1976 [AU] Australia ..... PC6327

[51] Int. Cl.[2] ..... G03G 53/04

[52] U.S. Cl. ..... 96/1.5 R; 96/1 LY

[58] Field of Search ..... 96/1.5, 1.8

[56] References Cited

U.S. PATENT DOCUMENTS

| | | | |
|---|---|---|---|
| 2,599,542 | 6/1952 | Carlson | 96/1.5 |
| 2,917,385 | 12/1959 | Byrne | 96/1.5 |
| 3,005,707 | 10/1961 | Kallmann et al. | 96/1.5 |
| 3,013,890 | 12/1961 | Bixby | 96/1 R X |
| 3,084,043 | 4/1963 | Gundlach | 96/1 LY |
| 3,281,857 | 10/1966 | Kaiser | 96/1 R X |
| 3,288,605 | 11/1966 | Macklem | 96/1 R |
| 3,346,475 | 10/1967 | Matkan et al. | 96/1.3 X |
| 3,409,899 | 11/1968 | Cowan et al. | 346/74 ES |
| 3,594,159 | 7/1971 | Kaufman | 96/1 R |
| 3,737,311 | 6/1973 | Wells | 96/1 R |
| 3,941,593 | 3/1976 | Butement | 96/1.5 |

FOREIGN PATENT DOCUMENTS

| | | | |
|---|---|---|---|
| 797027 | 6/1958 | United Kingdom | 96/1 R |
| 873080 | 7/1961 | United Kingdom | 96/1 LY |
| 954052 | 4/1964 | United Kingdom | 96/1 R |

*Primary Examiner*—Roland E. Martin, Jr.

*Attorney, Agent, or Firm*—Larson, Taylor and Hinds

[57] ABSTRACT

This specification discloses an improved electrophotographic image receiving plate having a base including one or more electrophotographic layers and an array of electrically discrete conducting elements arranged in electrical contact with one of the photoconductive layers, and an electrically conducting grid arranged adjacent to but insulated from each of the discrete elements. In one form the grid surrounds the discrete elements and is coplanar therewith. In another embodiment the grid is applied to an insulating layer deposited over the discrete elements. In use, a potential difference is applied between the grid and the discrete elements to create an electric field which develops an image on the discrete elements.

6 Claims, 4 Drawing Figures

ELECTROPHOTOGRAPHIC IMAGE RECEIVING PLATES

This invention relates to improvements in electrophotographic image receiving plates.

In U.S. Pat. No. 3,941,593 there is described a method of electrophotographically forming a printable image using an electrophotographic plate having a multiplicity of electrically conducting discrete elements arranged in a regular array on the surface of a photoconductive layer with said elements defining part of the surface of said plate. A voltage pattern corresponding to an image to which the plate is exposed is created at the elements as described in the patents and a developer fluid carrying a printing medium therein is passed between said plate surface and an opposing electrode while a voltage is applied between said plate surface and said opposing electrode to generate an electric field in said fluid. In this way printing medium is collected from said developer fluid and attracted towards said array of discrete elements at a rate dependent upon the voltage pattern on said array to form a printable image.

It is the object of this invention to provide an improved form of electrographic image receiving plate whereby the opposing electrode, which is a necessary part of the apparatus used in the above method, can be eliminated.

The present invention provides an improvement in an electrophotographic plate of the general type described above comprising an electrically conducting grid arranged adjacent to but insulated from each of said discrete elements, and means for applying a potential difference between said grid and said discrete elements whereby in use an electric field capable of developing an image is established between the grid and the discrete elements.

Preferred embodiments of the present invention will now be described with reference to the accompanying drawings in which.

Figure 1:
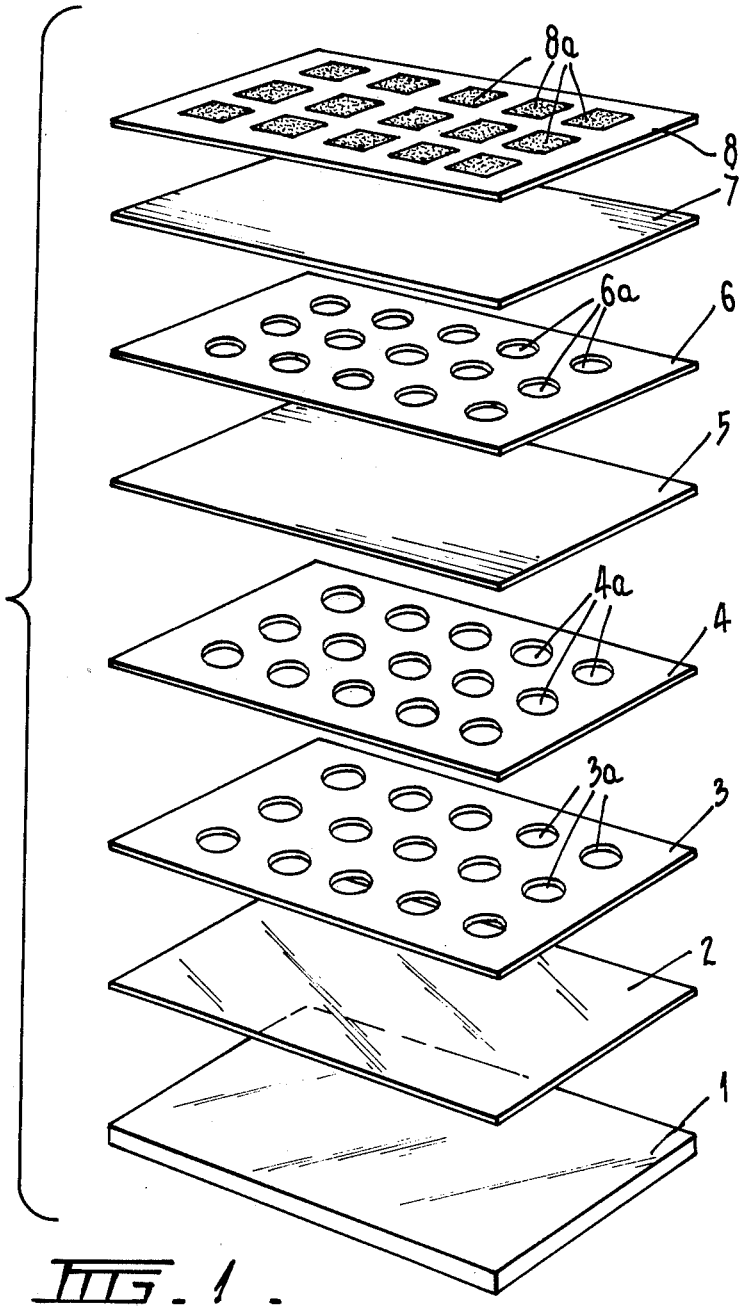
FIG. 1. PRIOR ART
FIG. 1 is an exploded schematic view of an electrographic plate according to the prior art.

The electrographic plate shown in FIG. 1 is of the general type described in U.S. Pat. No. 3,941,593 Butement (Australian Pat. No. 460,123) with reference to FIGS. 6, 7 and 8 of the drawings thereof. The method of manufacture of this plate is basically identical to the method described in the above patent although certain practical changes have been made in the construction of the plate. For this reason the various components of the plate and their manufacturing procedure will be described in general terms only and reference should be had to the description contained in the above patent for further details relating to the manufacture of the plate. It will also be appreciated that the drawings are a simplified schematic representation of the construction of the plate and accordingly the relative sizes and positioning of the various components are not characteristic of a practical electrographic plate construction.

The prior art electrographic plate construction shown in FIG. 1 comprises a base sheet of transparent material 1, which is preferably glass coated with a layer 2 of optically transparent electrically conductive material such as tin oxide. Such coated glass is available under the registered trade mark NESA. A thin layer 3 of opaque conductive material, such as chromium, is vacuum evaporated onto the tin oxide coating 2 so as to form a layer approximately 1 micron thick.

A layer of insulating material 4, such as Shipley EZ 111, is spin coated onto the layer 30 so as to form a coating from 0.1 to 1.0 micron thick. The insulating layer 4 and the conductive layer 3 are etched to form an array of closely spaced small diameter holes 3*a* and 4*a* therein, as shown schematically in the drawings. As one example, the holes may be 0.009 cm in diameter and spaced at 0.025 cm centres.

The holes 3*a* in layer 3 operate to define the areas of photoconductive material (described below) which are exposed to light passing through the base 1. Since this layer mainly functions to mask the photoconductive layer it need not be conductive and may be formed from an insulating material.

A layer of photoconductive material 5, such as selenium or a selenium/tellurium alloy, is vacuum evaporated over the insulating layer 4 so as to form a layer approximately 3 to 4 micron thick. A further conductive layer 6 is then vacuum evaporated over the photoconductive layer 5. This layer is preferably gold or any other suitable conductive material and is from 0.5 to 1.0 micron thick. The layer 6 is formed with a pattern of holes 6*a* corresponding to the holes 3*a* and 4*a* in the layers 3 and 4. However, these holes are approximately 0.015 cm in diameter. This layer constitutes the conducting mesh described in U.S. Pat. No. 3,941,593.

A further photoconductive layer 7 is vacuum evaported over the conductive layer 6. This layer 7 is identical in every respect to the layer 5. It will be appreciated that the layer 7 is in electrical contact with the layer 5 via the holes 6*a* while the layer 5 is in electrical contact with the layer 2 via holes 4*a* and 3*a*.

A further layer of conductive material 8, such as gold, is then vacuum evaporated over the photoconductive layer 7 and the layer is etched to form a regular array of square electrically conducting discrete elements 8*a* thereon. The discrete elements 8*a* may have sides 0.023 cm long and may be spaced by about 0.0025 cm.

The use of two photoconductive layers in the plate construction ensures that there is adequate insulation between the conductive layer 6 and the conductive layer 2 on the Nesa glass. If desired alternative insulating layers may be used to achieve the same effect.

It will be appreciated that the above described electrographic plate is in essence identical to the plate described in conjunction with FIGS. 6, 7 and 8 of the patent referred to above and that accordingly an opposing electrode (not shown) is essential in order to achieve attraction of the printing medium from the developer fluid towards the array of discrete elements 8*a* on the face of the plate. The main disadvantage of this arrangement is that a small and accurate spacing must be maintained between the surface of the plate and the opposing electrode. This is difficult to achieve and maintain under practical operation conditions and inhibits the flow of developing fluid across the surface of the plate.

Figure 2:
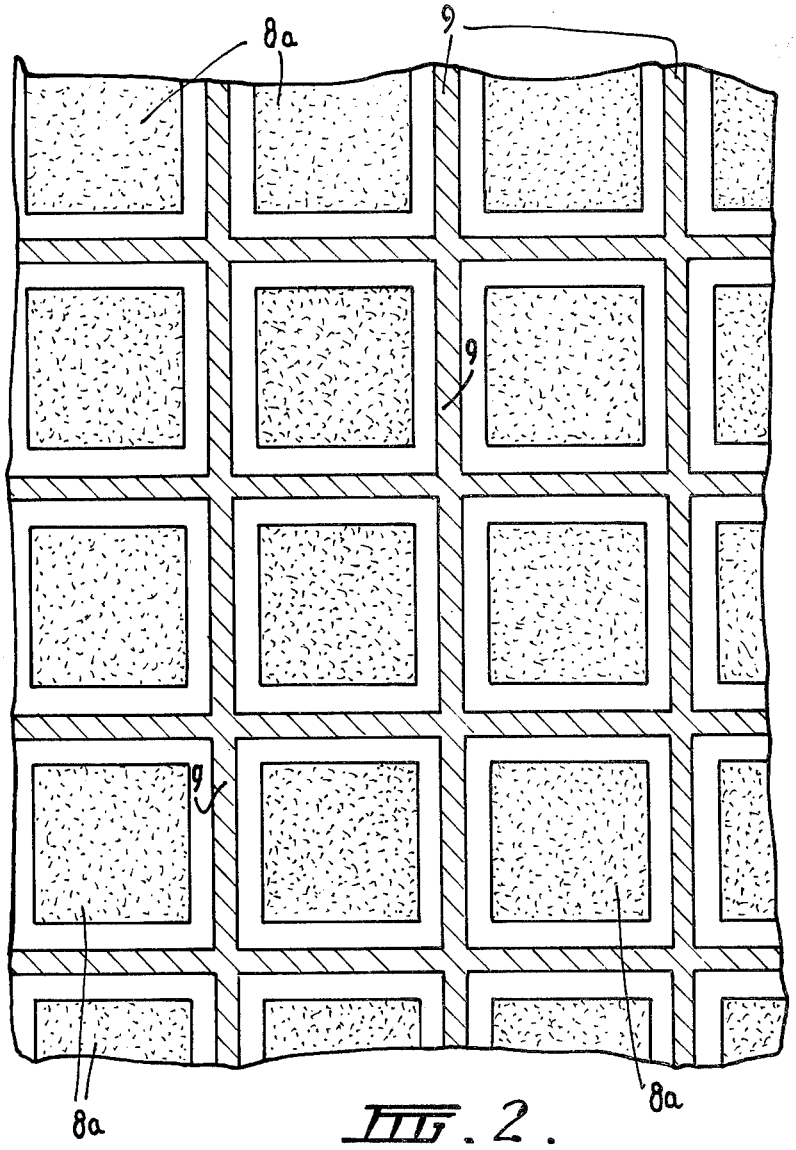
FIG. 2 is a plan view of part of the face of an electrographic plate modified in accordance with one embodiment of the present invention.

The necessity for a closely spaced opposing electrode is removed in accordance with one embodiment of the present invention which is shown in FIG. 2 of the accompanying drawings. In this embodiment the conductive layer 8 of the electrographic plate shown in FIG. 1 is modified to introduce an electrically conductive grid system 9 surrounding each of the discrete areas 8*a* but electrically insulated from them. In introducing the grid system 9 the size of the discrete elements 8*a* is reduced so that the length of each side is approximately 0.018 cm. The elements of the grid system are approximately 0.003 cm wide and the spacing between each discrete element 8*a* and the grid system 9 is about 0.003 cm. Since the photoconductive layer 7 on which the grid 9 and discrete elements 8*a* are deposited is effectively in the dark in use, and selenium or selenium/tellurium alloy has a high electrical resistance in the dark, the grid 9 and the discrete elements 8*a* are effectively insulated from each other using the above spacing.

Figure 3:
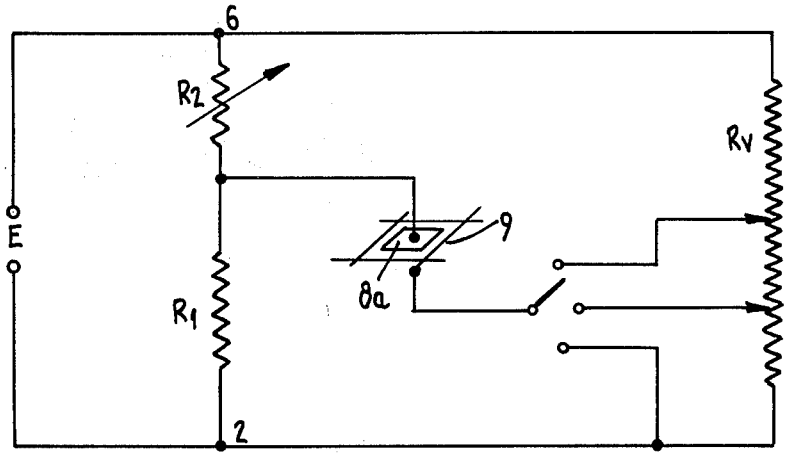
FIG. 3 is the equivalent electrical circuit for the plate of FIG. 2.

Referring now to FIG. 3, the equivalent circuit of the electrographic plate as modified in accordance with FIG. 2 is shown. In this circuit, E represents the voltage applied to the plate between the two electrically conducting layers 2 and 6. $R_1$ represents the resistive element connecting the conductive layer 6 with the discrete elements 8*a* while $R_2$ represents the variable resistance of the photoconductive layers 5 and 7. $R_v$ is a variable resistor used to control the potential applied to the grid 9 via the voltage divider switch connections shown whereby the potential difference between the grid 9 and the discrete elements can be adjusted to establish the required electric field therebetween to achieve development of an image.

If the equivalent circuit of FIG. 3 is compared with the equivalent circuit of FIG. 5 of U.S. Pat. No. 3,941,593 it will be noted that the coplanar grid system 9 effectively replaces the metallic plate 40 which acts as the opposing electrode referred to above. Thus in the arrangement according to the present invention, the electric fields which are required to develop an image on the electrographic plate are formed between the grid system 9 and the discrete elements 8*a* thereby removing the need for the opposing electrode. To develop an image on the electrographic plate described above, it is simply necessary to pass a developer fluid across the exposed surface of the plate. Thus, it is no longer necessary to keep a small accurate spacing between the surface of the plate and an opposing electrode thereby allowing easier access to the surface of the plate and facilitating development by dry powder techniques.

Figure 4:
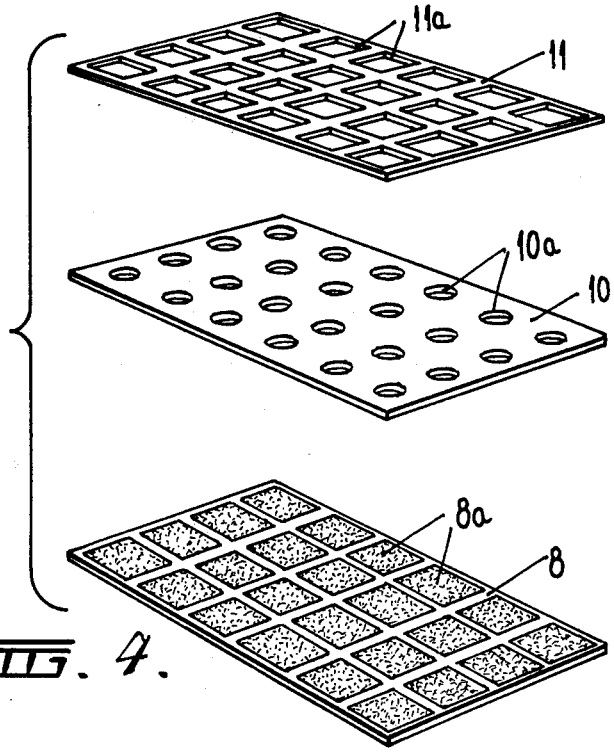
FIG. 4 is an exploded schematic view of part of an electrographic plate modified according to an alternative embodiment of the present invention.

Referring now to FIG. 4 of the drawings, the alternative embodiment of the invention shown therein has a basic plate construction similar to the first embodiment and accordingly components 1 to 7 thereof are not shown. In this embodiment a layer of insulating material such was Kodak (Registered Trade Mark) KPR photoresist is spin coated onto the discrete elements 8*a* to form a layer from 0.1 to 1.0 micron thick. The layer 10 is formed with an array of holes 10*a* centered on the discrete elements 8*a*. The holes 10*a* have a diameter of 0.020 cm while the discrete elements 8*a* have sides above 0.023 cm long. A further layer of conductive material 11, as gold is vacuum evaporated on the insulating layer 10 and has square holes having 0.0020 cm sides etched therein to form a grid system 11*a* similar to the grid system 9 of the above embodiment. The holes are located directly over the discrete elements 8*a* so that there is some overlap between the grid system 11*a* and the elements 8*a*. However, this is not necessary and the holes defining the grid may be larger than the elements 8*a*. In the present embodiment the grid system 11*a* is positively insulated from the discrete elements 8*a* by means of the insulating layer 10. The equivalent electrical circuit for this embodiment is as shown in FIG. 3 of the drawing.

The above embodiment is particularly useful for electrographic plate constructions in which the photoconductive layers 5 and 7 are of the type which do not have a high dark resistivity or if for some reason the top surface of the plate is required to be illuminated. It will be appreciated that while the grid system 11*a* is spaced from the discrete elements 8*a* by the insulating layer 10, the layer 10 is so thin as to not affect the creation of an electric field between the grid system 11*a* and the discrete elements 8*a*. Accordingly this embodiment of the invention operates in exactly the same manner as the previous embodiment.

In any practical form of the embodiments of FIG. 2 or 4 it is desirable that the top surface of the plate be planar. For this reason the areas of layer 8 or 11 which are etched away to create the grid system 9 or 11*a* are filled with a suitable insulating material, such as Kodak KPR photoresist.

It should be appreciated that the dimensional data given above is not in any way essential to the invention and is given only as a practical indication of the dimensions required. Similarly, while in each of the embodiments described above the electrically conducting discrete elements 8*a* are deposited on a photoconductive layer, this is not essential to the invention. The only requirement is that there be contact between the photoconductive layer and the discrete elements and this may be achieved in various ways. Furthermore, the described shape of the discrete elements and grid system may be changed without losing the advantages of the invention.

I claim:

1. In an electrophotographic image receiving plate of the type including a photoconductive member and an array of electrically conducting discrete elements arranged in electrical contact with said photoconductive member, the improvement comprising an electrically conducting grid arranged adjacent to but insulated from each of said discrete elements, and means for applying a potential difference connected between said grid and said discrete elements whereby in use an electric field capable of developing an image is established between the grid and the discrete elements.

2. The improvement of claim 1, wherein said grid is substantially coplanar with and surrounds each of said discrete elements with a space between said grid and said discrete elements whereby said grid is effectively insulated from said discrete elements.

3. The improvement of claim 1, wherein said grid is insulated from said discrete elements by means of an insulating material disposed between said discrete elements and said grid.

4. An electrophotographic image receiving plate comprising a transparent base, a layer of optically transparent electrically conducting material on said base, a layer of photoconductive material in contact with said layer of optically transparent electrically conducting material, an array of electrically conducting discrete elements in contact with said photoconductive layer, an electrically conducting mesh electrically connected to said discrete elements, means for applying a potential difference between said optically transparent electrically conducting layer and said electrically conducting mesh whereby when said plate is illuminated with an image, a voltage pattern is induced in image relation on said discrete elements, the improvement comprising an electrically conducting grid arranged adjacent to but insulated from each of said discrete elements, and means for applying a potential difference connected between said grid and said discrete elements whereby in use an electric field capable of developing an image is established between the grid and the discrete elements.

5. The improvement of claim 4, wherein said grid is substantially coplanar with and surrounds each of said discrete elements with a space between said grid and said discrete elements whereby said grid is effectively insulated from said discrete elements.

6. The improvement of claim 4, wherein said grid is insulated from said discrete elements by means of an insulating material disposed between said discrete elements and said grid.

* * * * *